US011208298B2

(12) United States Patent
Förander et al.

(10) Patent No.: US 11,208,298 B2
(45) Date of Patent: Dec. 28, 2021

(54) SIDE LIFT SPREADER FOR LIFTING INTERMODAL CONTAINER

(71) Applicant: ELME SPREADER AB, Älmhult (SE)

(72) Inventors: Erik Förander, Virestad (SE); Örjan Karlsson, Lund (SE)

(73) Assignee: ELME SPREADER AB

( * ) Notice: Subject to any disclaimer, the term of this patent is extended or adjusted under 35 U.S.C. 154(b) by 304 days.

(21) Appl. No.: 16/498,568

(22) PCT Filed: Mar. 31, 2017

(86) PCT No.: PCT/EP2017/057687
§ 371 (c)(1),
(2) Date: Sep. 27, 2019

(87) PCT Pub. No.: WO2018/177534
PCT Pub. Date: Oct. 4, 2018

(65) Prior Publication Data

US 2021/0087024 A1 Mar. 25, 2021

(51) Int. Cl.
*B66C 1/10* (2006.01)
*B66F 9/18* (2006.01)
*B66C 1/66* (2006.01)

(52) U.S. Cl.
CPC ..... *B66C 1/104* (2013.01); *B66F 9/186* (2013.01); *B66C 1/663* (2013.01)

(58) Field of Classification Search
CPC ..... B66C 1/104; B66C 1/663; B66F 9/186
See application file for complete search history.

(56) References Cited

U.S. PATENT DOCUMENTS

| | | | | |
|---|---|---|---|---|
| 4,449,882 A * | 5/1984 | Perrott | B66F 9/186 294/81.2 |
| 4,606,568 A | 8/1986 | Karlsson | |
| 6,086,316 A * | 7/2000 | Sundermeijer | B66F 9/186 294/110.1 |
| 6,431,625 B1 * | 8/2002 | Copier | B66F 9/186 294/81.5 |
| 9,394,149 B2 * | 7/2016 | Karlsson | B66F 9/186 |
| 9,751,739 B2 * | 9/2017 | Karlsson | B66F 9/16 |

FOREIGN PATENT DOCUMENTS

| | | |
|---|---|---|
| EP | 0701964 A1 | 3/1996 |
| EP | 2628702 A1 | 8/2013 |

* cited by examiner

*Primary Examiner* — Jonathan Snelting
(74) *Attorney, Agent, or Firm* — Condo Roccia Koptiw LLP

(57) ABSTRACT

A side lift spreader main beam (22) comprises a vertical carrier plate (58) having a first vertical height (H1) and being made of steel plate having a first thickness (T1); a C-beam (60) comprising a first horizontal flange (64) and a second horizontal flange (66) interconnected by a vertical web portion (68), the C-beam (60) having a second vertical height (H2) lower than the first vertical height (H1) and being made of steel plate having a second thickness (T2) thinner than the first thickness (T1), wherein the C-beam (60) defines, together with the carrier plate (58), a closed channel beam with a first flange (74) of the carrier plate (58) extending vertically from the closed channel beam; and an inclined support plate (62) welded to the carrier plate, and to an outer face of the first flange (64) of the C-beam (60) at a distance from the carrier plate (58).

20 Claims, 6 Drawing Sheets

Fig. 5
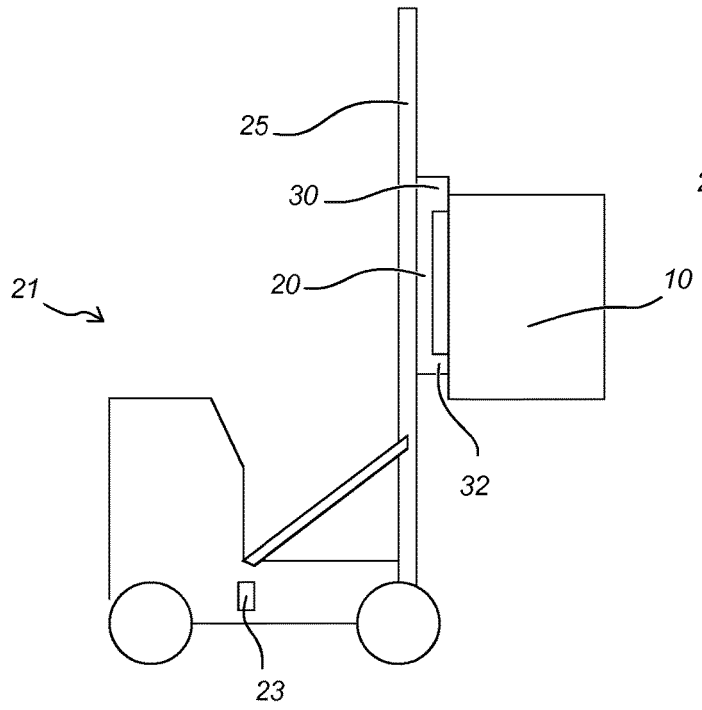
Fig. 6
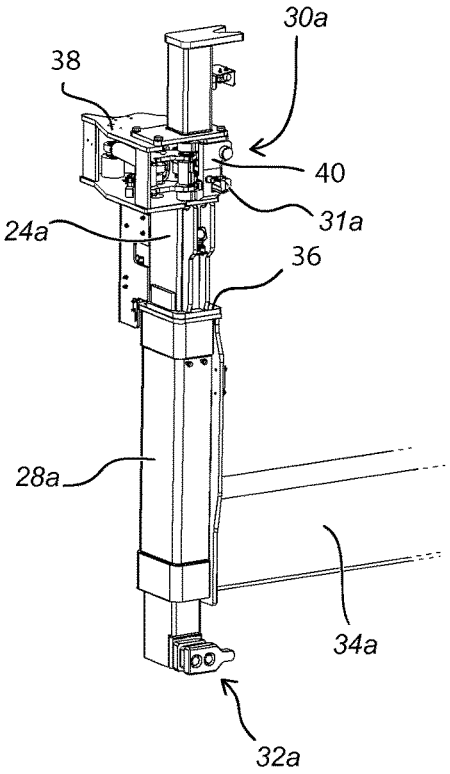
Fig. 7A
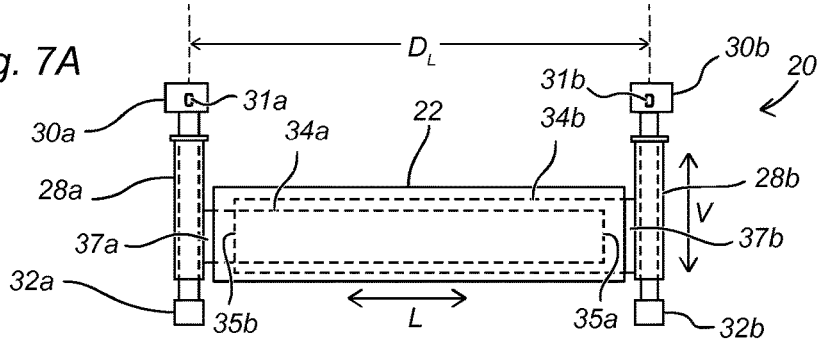
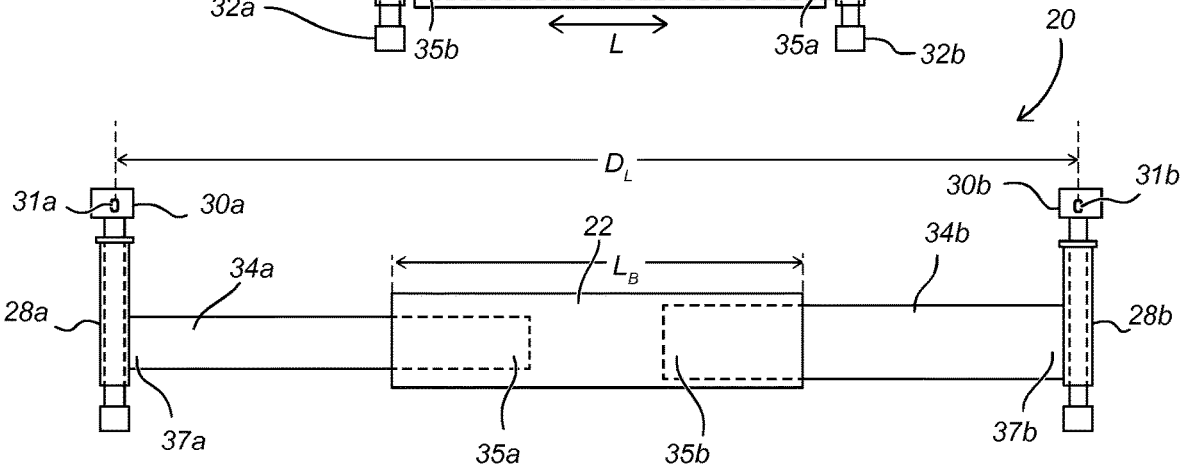
Fig. 7B

SIDE LIFT SPREADER FOR LIFTING INTERMODAL CONTAINER

CROSS REFERENCE TO RELATED APPLICATIONS

This application is the National Stage Entry under 35 U.S.C. § 371 of Patent Cooperation Treaty Application No. PCT/EP2017/057687, filed Mar. 31, 2017, the contents of which are hereby incorporated by reference herein.

FIELD OF THE INVENTION

The present invention relates to a side lift spreader for lifting an intermodal transport container.

BACKGROUND OF THE INVENTION

An intermodal container is a standardized shipping container which can be used across and transferred between different modes of transport, such as rail, truck and ship, without unloading and reloading the cargo inside the container. Containers and other types of rigid load carriers of different standard dimensions are normally handled with the aid of a container spreader or yoke, which may typically be carried by a truck or a crane. The spreader attaches to a container at lifting castings, which are often called corner castings as they are typically arranged in all corners of a standard 20- or 40-foot container. For the purpose, the spreader is provided with a plurality of container locking arrangements, such as lifting hooks or twist-locks. Often, the spreader is telescopic so as to allow changing the distance between container locking arrangements along a longitudinal axis of the container, in order to accommodate for containers of different standard lengths. Standards for intermodal containers are specified by the International Organization for Standardization, ISO, e.g. in the standards ISO 668:2013 and ISO 1496-1:2013.

Side lift spreaders are generally used for lifting empty containers, since due to the relatively low weight of an empty container, it may be sufficient to connect to the corner castings of a single lateral side of the container. Side lift spreaders may typically be carried by a lifting truck for moving the containers within e.g. a cargo terminal area. An exemplary side lift spreader for simultaneously handling two containers is shown in EP 0701964.

Container spreaders are used for handling large and heavy loads, and are exposed to high levels of stress. At the same time, there are also other requirements that need to be met by a spreader. By way of example, it should be possible to produce and operate at a reasonable cost.

SUMMARY OF THE INVENTION

It is an object of the present invention to solve, or at least mitigate, parts or all of the above-mentioned problems. To this end, there is provided a side lift spreader for lifting an intermodal transport container, the spreader comprising a main beam extending in a longitudinal direction; a pair of container locking arrangements, each of said container locking arrangements being located at a respective longitudinal end of the spreader and being configured to be connected to a respective top corner casting of the container; and a container side support configured to support a longitudinal side of the container at a position vertically lower than the pair of container locking arrangements, the spreader being characterized in that the main beam comprises an elongate, vertical carrier plate, the longitudinal axis of which extending in said longitudinal direction, the carrier plate having a first vertical height and being made of steel plate having a first thickness; a C-beam extending in the longitudinal direction and comprising, as seen in cross-section, a first horizontal flange and a second horizontal flange interconnected by a vertical web portion, the C-beam having a second vertical height lower than the first vertical height and being made of steel plate having a second thickness thinner than the first thickness, the first flange of the C-beam being welded to the carrier plate along a first longitudinal weld and the second flange of the C-beam being welded to the carrier plate along a second longitudinal weld such that the C-beam defines, together with the carrier plate, a closed channel beam with a first flange of the carrier plate extending vertically from the closed channel beam; and an elongate, inclined support plate extending along the longitudinal direction, the support plate being welded to the carrier plate along a third longitudinal weld, and to an outer face of the first flange of the C-beam along a forth longitudinal weld, the fourth longitudinal weld being located at a distance from the carrier plate. Using a main beam as defined above, the overall weight of the main beam can be significantly reduced, with maintained or increased strength. The weight reduction translates to a lower production cost of the spreader as well as significantly reduced tire wear on any truck carrying the spreader. The spreader may also be made with fewer, or completely without, transversal reinforcement bands welded across the main beam. The main beam will thereby be relatively free from transversal welds, which would otherwise define transversal lines of weakness across the top of the beam—lines of weakness that could potentially allow the formation of cracks, and that would require the transversal reinforcement bands as well as the main beam itself to have a substantial material thickness to compensate for the loss of strength due to the welds. Expressed somewhat differently, compared to known designs, the design defined above enables increasing the strength per unit weight, which allows increasing the strength, and/or reducing the weight, of the spreader. A thickness difference between the first and second thicknesses may, by way of example, be between 5 mm and 15 mm, or between 8 mm and 12 mm. The first thickness may, by way of example, be between 15 mm and 30 mm, or between 19 mm and 26 mm. Also the support plate may have a thickness thinner than the first thickness. The support plate thickness may, for example, be substantially the same as, or thinner than, the second thickness. Throughout this disclosure, any references to "horizontal" and "vertical" refer to the orientation of the spreader when in use, i.e. when oriented to engage with and lift an ISO container placed with its bottom on flat, horizontal ground.

According to an embodiment, the main beam may be configured as a traveling beam guide, wherein the spreader further comprises a pair of traveling beams, each of said traveling beams having a proximal end guided in the main beam to allow movement along the longitudinal direction, and a distal end connected to a respective container locking arrangement of said pair of container locking arrangements, thereby allowing changing the longitudinal distance between the container locking arrangements to accommodate for containers of different lengths. Optionally, one of said traveling beams may be guided by the main beam to telescopically slide into the other of said traveling beams. Such a configuration results in a particularly compact spreader.

According to an embodiment, the C-beam may be welded to a side of the carrier plate configured to face, when the spreader is in use, towards the container to be lifted.

According to an embodiment, said first flange of the carrier plate may extend upwards from the closed channel beam defined by the C-beam and the carrier plate. Such an arrangement results in a particularly high strength.

According to an embodiment, said side lift spreader may further comprise a beam suspension arrangement carrying said main beam, wherein said second flange of the C-beam has a bottom face slidingly resting on said beam suspension arrangement to allow moving the main beam relative to the beam suspension arrangement in said longitudinal direction.

According to an embodiment, the carrier plate may be provided with a second flange extending vertically downwards from the closed channel beam. Such a flange may provide added transversal support for guiding the main beam in the longitudinal direction along the beam suspension arrangement.

According to an embodiment, said inclined support plate may extend along less than ¾ of a total length of the main beam. Additionally or alternatively, the inclined support plate may extend along more than ½ of a total length of the main beam. Such a design may result in a low weight of the spreader without substantially reducing the strength. A longitudinal centre of the support plate may substantially coincide with a longitudinal centre of the C-beam.

According to an embodiment, a plane defined by said inclined support plate may form an angle of between 30° and 75° with a plane defined by the carrier plate. Such an arrangement results in a particularly high strength.

According to an embodiment, said distance between the fourth longitudinal weld and the carrier plate may be between 50% and 100% of the horizontal width of the first flange of the C-beam, as seen in a horizontal direction perpendicular to the longitudinal direction. Such an arrangement results in a particularly high strength.

According to an embodiment, the first and second locking arrangements may be movable between a 20-foot position, in which the longitudinal distance between the pair of container locking arrangements is adapted for engaging with the corner castings of a 20-foot ISO container, and a 40-foot position, in which the longitudinal distance between the pair of container locking arrangements is adapted for engaging with the corner castings of a 40-foot ISO container.

According to an embodiment, the carrier plate may extend along more than ¾ of the longitudinal length of the main beam.

According to an embodiment, the C-beam may extend along more than ¾ of the longitudinal length of the main beam.

According to an embodiment, each of said container locking arrangements may comprise a lifting hook provided with a barb, the barb being configured for engaging with an inner top edge of a twist-lock aperture on a longitudinal side of a container to be lifted. Alternatively or additionally, the container locking arrangements may comprise twist-locks.

BRIEF DESCRIPTION OF THE DRAWINGS

The above, as well as additional objects, features and advantages of the present invention, will be better understood through the following illustrative and non-limiting detailed description of preferred embodiments of the present invention, with reference to the appended drawings, where the same reference numerals will be used for similar elements, wherein:

FIG. 5 is a schematic side view of a lifting truck provided with the spreader of FIG. 4, carrying the container illustrated in FIG. 1;

FIG. 6 is a schematic view in perspective of a portion of the spreader of FIG. 4;

FIG. 7A is a schematic front view of the spreader of FIG. 4 when in a first position;

FIG. 7B is a schematic front view of the spreader of FIG. 4 when in a second position;

DETAILED DESCRIPTION OF THE EXEMPLARY EMBODIMENTS

Figure 1:
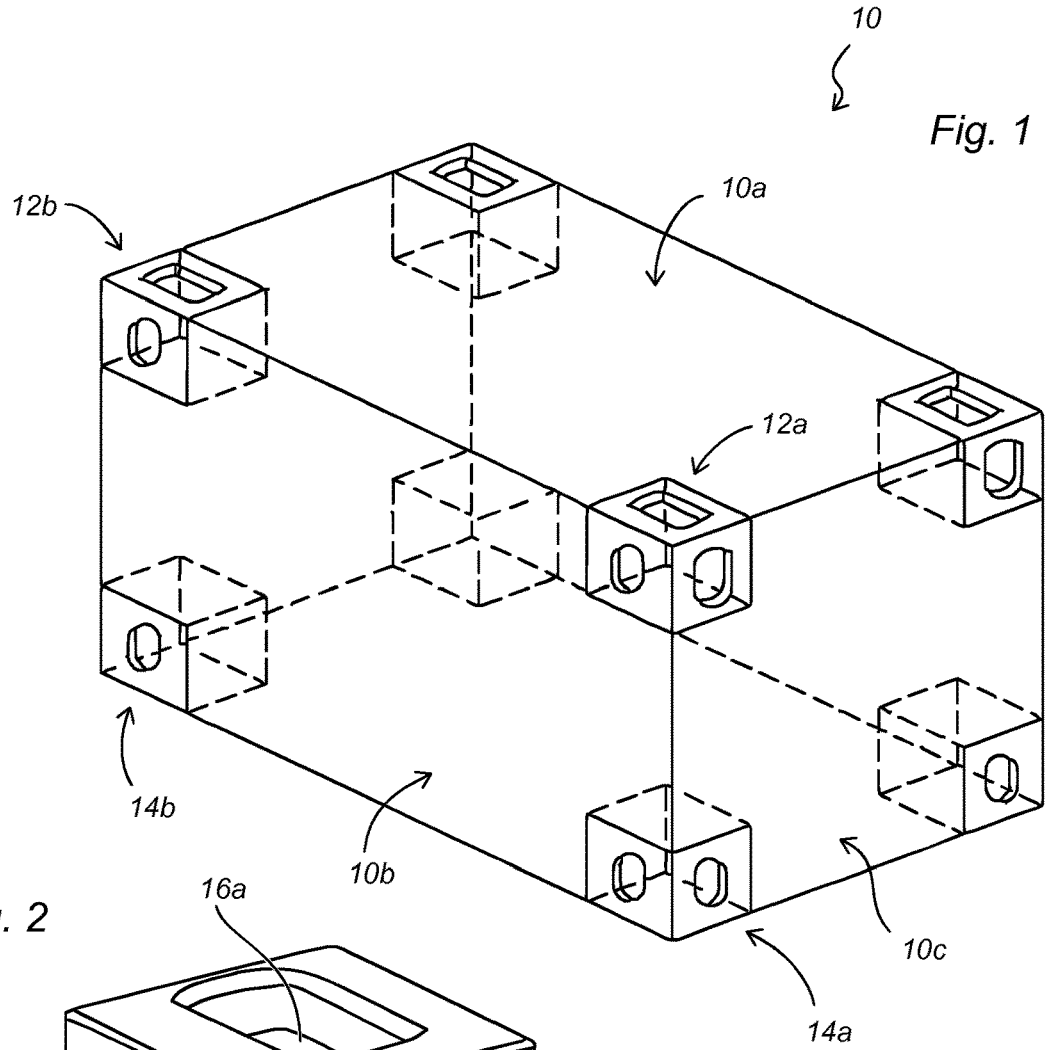
FIG. 1 is a schematic illustration in perspective of an intermodal container.

FIG. 1 schematically illustrates an intermodal container 10 according to the above-mentioned ISO standards. The container 10, which for clarity is illustrated transparent, has a top face 10*a*, a first longitudinal side 10*b*, and a first short side or gable side 10*c*. The container also has a bottom face, a second longitudinal side, and a second gable side, which are located opposite the top face, first longitudinal side, and first gable side, respectively. Each corner of the container 10 is provided with a respective corner casting for attaching a respective container locking arrangement, for the purpose of facilitating the handling of the container 10, and for locking the container to other containers or to the deck of a freight ship. Hence, the container top corners which define the top corners of the first longitudinal side 10*b* are provided with a first top corner casting 12*a* and a second top corner casting 12*b*. Similarly, the container bottom corners which define the bottom corners of the first longitudinal side 10*b* are provided with a first bottom corner casting 14*a* and a second bottom corner casting 14*b*.

Figure 2:
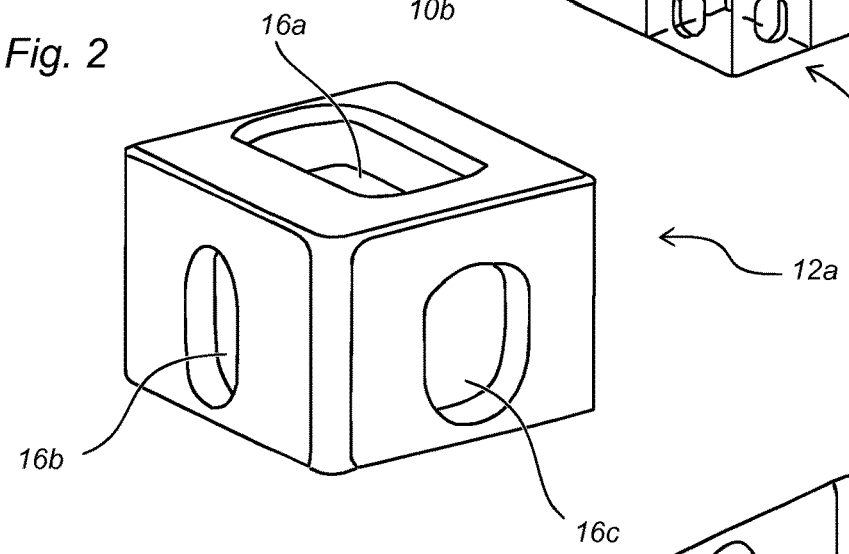
FIG. 2 is a schematic illustration in perspective of a top corner casting of the intermodal container of FIG. 1.

FIG. 2 illustrates the top corner casting 12*a* in greater detail, in the same perspective as that of FIG. 1. It is provided with a top face lock opening 16*a*, a longitudinal side lock opening 16*b*, and a gable lock opening 16*c*, each of which is configured to receive and engage with a male insert of a container locking arrangement, such as a lifting hook, twist-lock, or side clamp.

Figure 3:
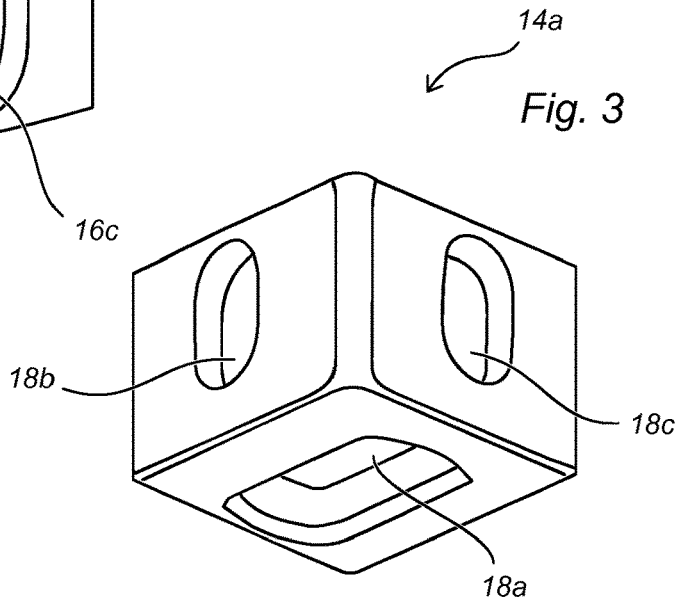
FIG. 3 is a schematic illustration in perspective of a bottom corner casting of the intermodal container of FIG. 1.

FIG. 3 illustrates the bottom corner casting 14*a* in greater detail, seen obliquely from below. It is provided with a bottom face lock opening 18*a*, a longitudinal side lock opening 18*b*, and a gable lock opening 18*c*, each of which is configured to receive and engage with a male insert of a container locking arrangement, such as a twist-lock or side clamp.

Referring back to FIG. 1, a side lift spreader is a container handling device configured for handling empty containers by connecting container locking arrangements, such as lifting hooks or twist-locks, only at corner castings arranged at a single longitudinal side 10*b* of the container. For example, a single-container spreader generally attaches to the top corner castings 12*a*, 12*b* of a single longitudinal side 10*b*. As each corner casting may be accessible from three different directions, it is however not necessary that the container locking arrangements access the corner castings from the longitudinal side. It is possible that the container locking arrangements access two corner castings, arranged at the same longitudinal side of the container, from above or from the gables of the container. In other words, even though a side lift spreader approaches the container from the longitudinal side 10*b* of the container 10 it is possible that the container locking arrangements of the side lift spreader access the corner castings from another direction, i.e. from the gables of the container or from above. Thus, a side lift spreader may handle a container 10 by connecting container locking arrangements to e.g. two top corner castings 12*a*, 12*b* of the container, wherein the remaining two top corner castings of the container are not used by the side lift spreader for handling the container 10. In this sense a side lift spreader is clearly different from a top-lift spreader that handles a container 10 by connecting container locking arrangements to all four upper corner castings of the container. Such top-lift spreaders are needed for lifting laden containers, which are much heavier than empty containers.

Figure 4:
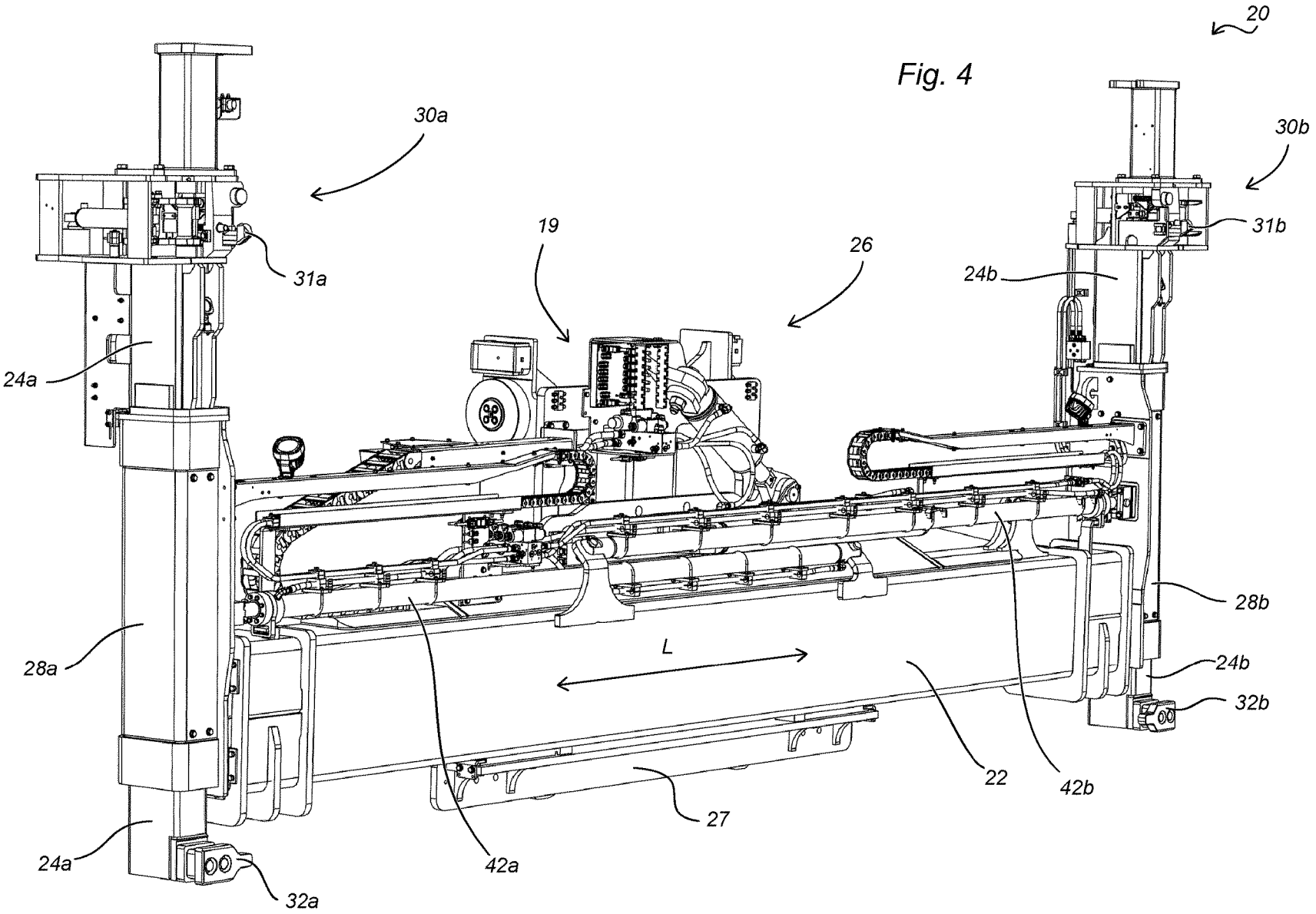
FIG. 4 is a diagrammatic view in perspective of a side lift spreader for handling intermodal containers.

FIG. 4 illustrates a side-lift spreader 20 for handling one or two intermodal containers according to the above-mentioned ISO standards. The spreader 20 comprises a horizontal main beam 22, which supports a pair of vertical carrier beams 24*a-b* at respective ends thereof. The vertical carrier beams 24*a-b* are telescopically connected to the main beam 22 via respective traveling beams (not illustrated), which are configured to telescopically extend from the respective ends of the main beam 22 along the longitudinal axis L of the main beam 22. Thereby, the horizontal distance between the vertical carrier beams 24*a-b* can be varied to allow lifting containers of different lengths. A truck mast coupling 26 is mounted centrally on the main beam 22, and is configured to be connected to the mast of a lifting truck (not illustrated). The mast coupling 26 carries the main beam 22 via a beam suspension arrangement 27, which allows the main beam 22 to be moved relatively to the mast along the longitudinal axis L by means of a hydraulic cylinder, which is not visible in the view of FIG. 4. Each vertical carrier beam 24*a*, 24*b* is vertically guided in a respective vertical sleeve 28*a*, 28*b*, which is welded to a distal end of the respective traveling beam (not illustrated). Each vertical carrier beam 24*a*, 24*b* extends both upwards and downwards from the respective vertical sleeve 28*a*, 28, and is provided with a respective container side support 32*a*, 32*b* at its bottom end. Adjacent to its top, each vertical carrier beam 24*a-b* is provided with a respective container locking arrangement 30*a*, 30*b* for connecting to the top corner castings 12*a*, 12*b* of the container 10 of FIG. 1. The container locking arrangements 30*a*, 30*b* are sometimes also referred to as spreader heads. Each container locking arrangement 30*a*, 30*b* is provided with a respective lifting hook 31*a*, 31*b* for engaging with the longitudinal side lock opening 16*b* (FIG. 2) of the respective top corner casting 12*a*, 12*b* (FIG. 1). Optionally, the container locking arrangements 30*a*, 30*b* may also connect to the bottom corner castings 14*a-b* of a second container 10, if the spreader is used for simultaneously lifting two containers stacked on top of each other. A spreader controller 19 is operably connected to various sensors and actuators of the spreader 20 in a non-illustrated manner.

FIG. 5 schematically illustrates the spreader of FIG. 4 connected to a lifting truck 21. The spreader 20 is vertically movable along a mast 25 to allow e.g. arranging of containers in high stacks. In the illustration of FIG. 5, the spreader 20 is connected to, and lifts, a single container 10, which is attached to the container locking arrangements 30 at its top corner castings 12*a*, 12*b* (FIG. 1). The longitudinal side 10*b* (FIG. 1) of the container 10 rests on a container side support 32. A truck control system 23 is operably connected to the spreader control system 19 (FIG. 4) in a non-illustrated manner.

FIG. 6 illustrates a first vertical carrier beam 24*a* of said pair of vertical carrier beams 24*a-b*, as carried by the vertical sleeve 28*a*. In the view of FIG. 6, the main beam 22 (FIG. 4) has been removed for clarity of illustration, to reveal the traveling beam 34*a* welded to the vertical sleeve 28*a*. A horizontal flange 36 of the vertical carrier beam 24*a* is configured to rest upon the upper end of the vertical sleeve 28*a*; otherwise, the vertical carrier beam 24*a* is free to slide vertically in the sleeve 28*a*, in order to compensate for any differences in the horizontal alignment between the pair of container locking arrangements 30*a-b* (FIG. 4) and the container 10 to be lifted (FIG. 1). A housing 38 protects the container locking arrangement 30*a* from impacts, and a front face portion 40 of the housing is configured to abut the corner casting 12*a* at the longitudinal side 10*b* of the container 10 to be lifted. The container side support 32*a* is configured to, once the container locking arrangement 30*a* has attached to the container 10 (FIG. 1), abut a lower portion of the longitudinal side 10*b* of the container 10.

FIGS. 7A and 7B schematically illustrate the spreader 20 in two different positions, as seen from the container to be lifted. For clarity of illustration, components of the spreader 20 unnecessary for illustrating the telescopic function are omitted in FIGS. 7A-B. The first and second container locking arrangements 30*a*, 30*b* define, together with the container side supports 32*a*, 32*b*, a rectangular pattern, a long side of which extends along the longitudinal direction L and a short side of which extends in the vertical direction V. The main beam 22 is hollow and defines a traveling beam guide for guiding the traveling beams 34*a*, 34*b*. Each of the traveling beams 34*a*, 34*b* has a respective proximal end 35*a*, 35*b* guided inside the main beam 22 to allow movement along the longitudinal direction L, and a respective distal end 37*a*, 37*b* welded to the respective vertical sleeve 28*a*, 28*b*, thereby allowing changing the longitudinal distance $D_L$ between the container locking arrangements to accommodate for containers of different lengths. In the view of FIG. 7A, the spreader 20 is contracted in the longitudinal direction L, such that the distance $D_L$ between the lifting hooks 31*a*, 31*b* corresponds to the distance between the longitudinal side lock openings 16*b* of a pair of top corner castings 12*a*, 12*b* of an ISO-standard 20-foot intermodal container. When in the contracted position illustrated in FIG. 7A, the proximal end 35*a* of the first traveling beam 34*a* is inserted inside the second traveling beam 34*b*, which is hollow. FIG. 7B illustrates the same spreader 10 extended in the longitudinal direction L, such that the distance $D_L$ between the lifting hooks 31*a*, 31*b* corresponds to the distance between the longitudinal side lock openings 16*b* of a pair of top corner castings 12*a*, 12*b* of an ISO-standard 40-foot intermodal container. FIG. 7B also illustrates the total length $L_B$ of the main beam 22, which is slightly less than 20 feet. By way of example, the main beam 22 may have a longitudinal length of between 4200 mm and 5900 mm.

Referring back to FIG. 4, the traveling beams 34*a*, 34*b* are moved in the longitudinal direction by means of respective hydraulic cylinders 42*a*, 42*b*, each of which has one end attached to the respective vertical sleeve 28*a*, 28*b*, and the other end to the main beam 22. The hydraulic cylinders 42*a*, 42*b* are arranged on the top face of the main beam 22.

Figure 8A:
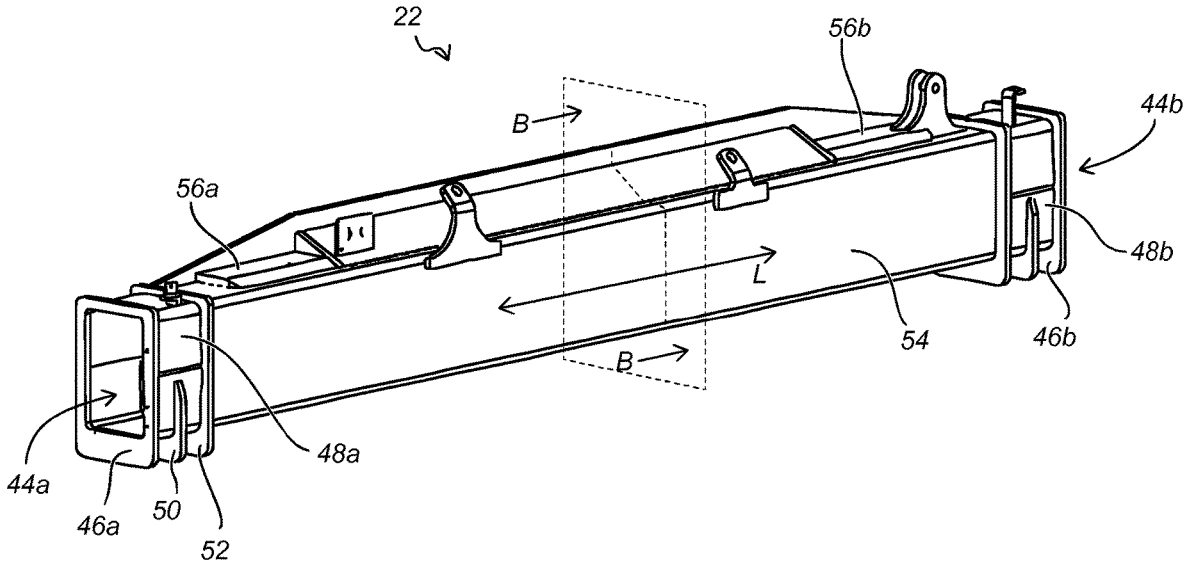
FIG. 8A is a diagrammatic view in perspective of a main beam of the spreader of FIG. 4.
Figure 8B:
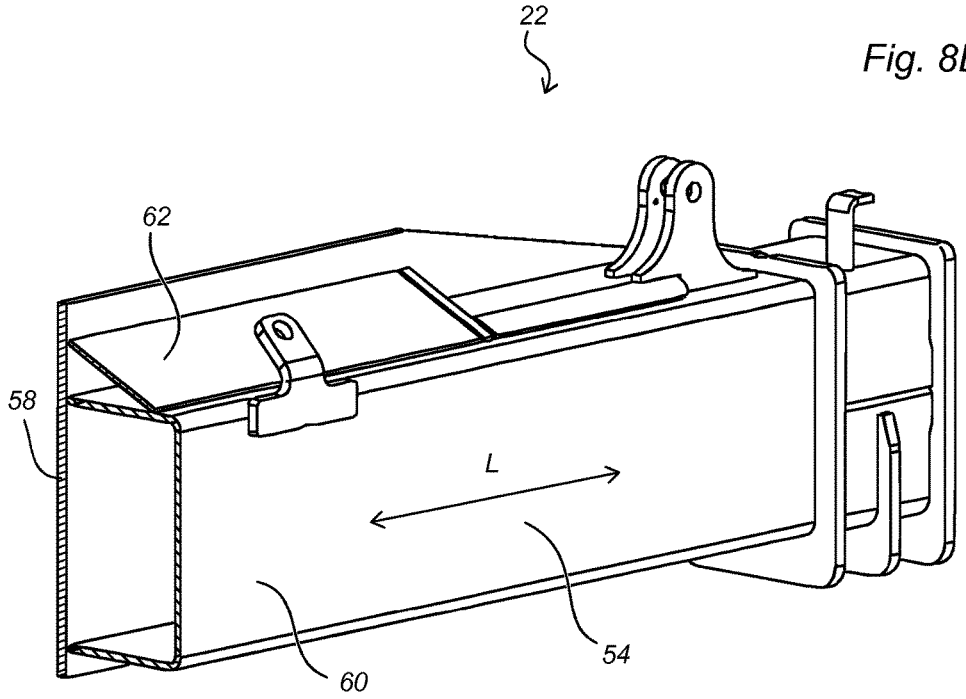
FIG. 8B is a diagrammatic view of the main beam of FIG. 8A in the same perspective, and as seen in a section taken along the plane B-B of FIG. 8A.
Figure 8C:
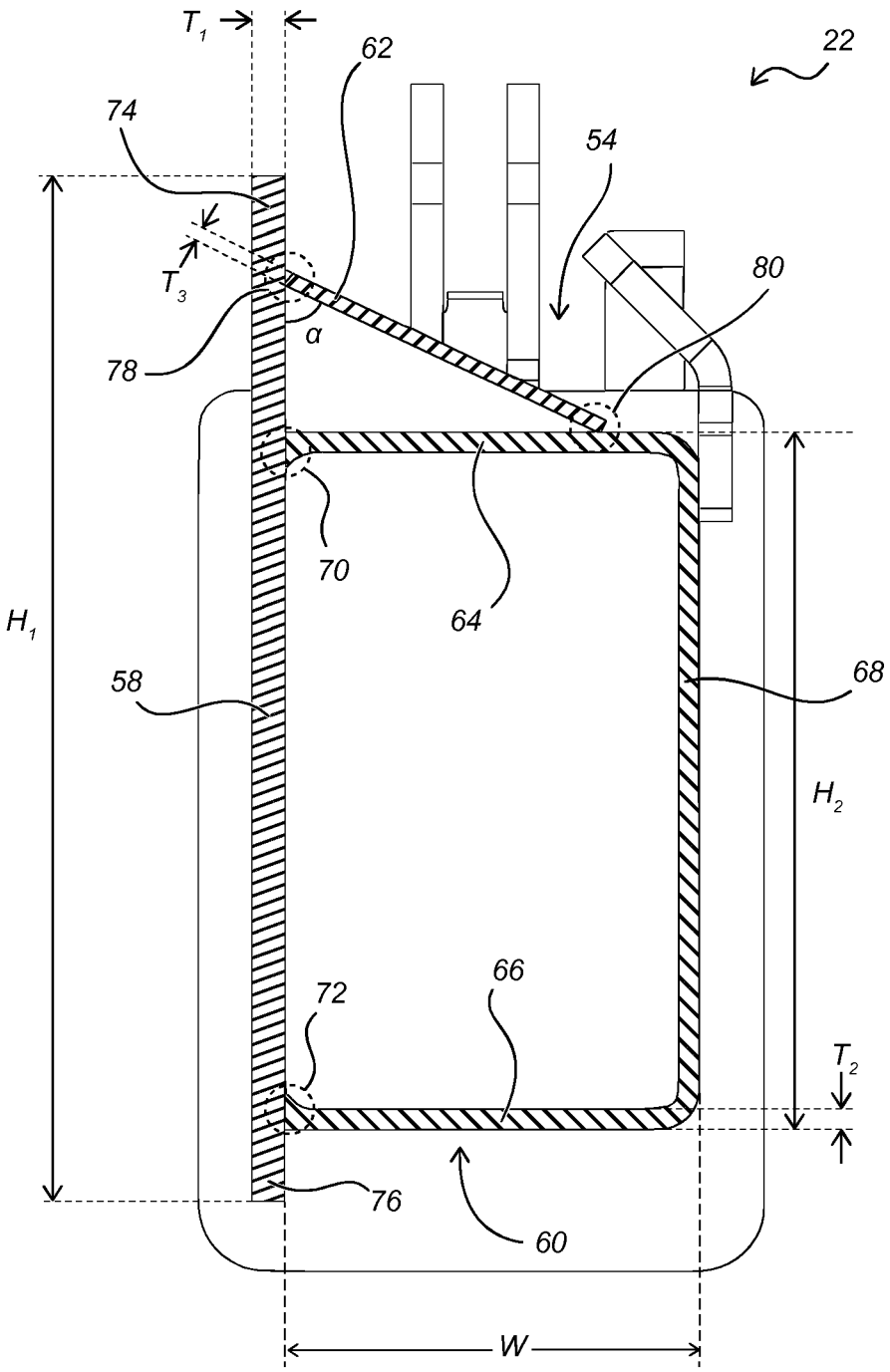
FIG. 8C is a diagrammatic view in section of the main beam of FIG. 8A, as seen in the plane B-B of FIG. 8A.

FIGS. 8A-8C illustrates in greater detail the main beam 22 of FIGS. 4 and 7A-7B, wherein FIG. 8B illustrates a cross-section of the main beam 22, taken along the plane VIII-VIII perpendicular to the main beam's 22 longitudinal direction L, as seen in perspective, and FIG. 8C illustrates the same cross-section as seen in the plane VIII-VIII.

Beginning with FIG. 8A, the main beam 22 has a first end opening 44*a*, which is configured to receive the proximal end 35*a* of the first traveling beam 34*a* (FIG. 7B). The first end opening 44*a* is provided with a first end collar 46*a*, which is welded to and reinforces the first end opening 44*a*. The first end collar 44*a* is made of a piece of steel plate extending in a plane perpendicular to the main beam's longitudinal direction L. A first end sleeve 48*a* of the main beam 22 is provided with additional collar plates 50, 52, which are welded to the first end sleeve 48*a* and extend in respective planes that are substantially parallel to the plane of the first end collar 46*a*. The main beam 22 also has a second end opening 44*b*, which is configured to receive the proximal end 35*b* of the second traveling beam 34*b* (FIG. 7B). Similar to the first end opening 44*a*, the second end opening 44*b* is provided with a second end collar 46*b* and a second end sleeve 48*b*, as well as additional collar plates along the length of the second end sleeve 48*b*. The end sleeves 48*a*, 48*b* are attached to respective ends of a main body 54 of the main beam 22. Top face reinforcement plates 56*a*, 56*b* are welded to the top face of the main beam 22 at the locations of the proximal ends 35*a*, 35*b* of the respective traveling beams 34*a*, 34*b* when the spreader is in the 40-foot position (FIG. 7B). Apart from those, the main body 54 is substantially free from reinforcements welded thereto along welds transversal to the longitudinal direction L.

The section of FIG. 8B illustrates a cross-section through the main body 54 of the main beam 22. The main beam 22 comprises a vertical carrier plate 58, a C-beam 60, and an inclined support plate 62, all of which are welded together along welds extending in the longitudinal direction L FIG. 8C illustrates the main body 54 of the main beam 22 in greater detail. The carrier plate 58 has a vertical height $H_1$, and is made of steel plate having a uniform thickness $T_1$ of about 20-25 mm. The C-beam 60 is defined by an upper horizontal flange 64 and a lower horizontal flange 66, which are interconnected by a vertical web portion 68. The C-beam 60 has a vertical height $H_2$ which is lower than $H_1$, and a horizontal width W, and is made of steel plate having a uniform thickness $T_2$ of about 10-15 mm. The upper flange 64 is welded to the carrier plate 58 along a first longitudinal weld 70, and the lower flange 66 is welded to the carrier plate 58 along a second longitudinal weld 72 such that the C-beam 62 defines, together with the carrier plate 58, a closed channel beam with free upper and lower flanges 74, 76 of the carrier plate 58 extending vertically from the closed channel beam. The inclined support plate 62 is made of steel plate having a uniform thickness $T_3$ of about 10 mm, and is welded between the carrier plate 58 and the outer face of the upper flange 64 of the C-beam along third longitudinal weld 78 and a fourth longitudinal weld 80, respectively. The support plate 62 forms an angle $\alpha$ of about 60° with the carrier plate 58.

Figure 9:
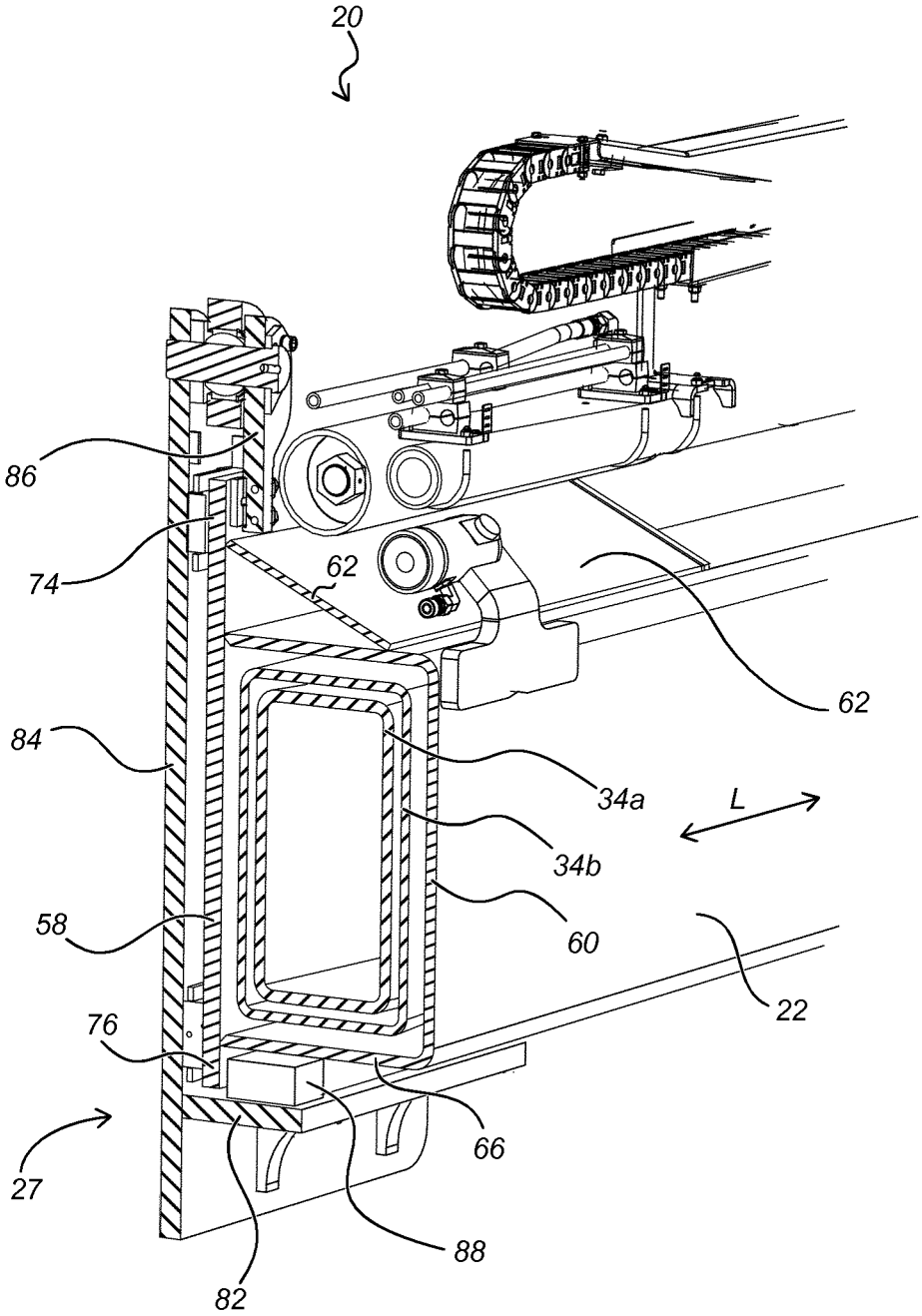
FIG. 9 is a diagrammatic view of the spreader of FIG. 4, in the same perspective as that of FIG. 8A, as seen in a section taken along the plane B-B of FIG. 8A, and with parts broken away.

FIG. 9 illustrates the spreader 20 (FIG. 4) in a section corresponding to the view of FIG. 8B. The beam suspension arrangement 27 comprises a horizontal bottom plate 82, onto which the main beam 22 slidingly rests. The bottom plate 82 is carried by a vertical back plate 84, which is attached to the mast coupling 26 (FIG. 4). A gripping arrangement 86 straddles the upper free flange 74 of the carrier plate 58, thereby stabilizing the main beam 22 from pivoting in the beam suspension arrangement 27 about the longitudinal axis L. Friction reducing slide blocks 88, one of which is visible in the view of FIG. 9, are distributed along the length of the beam suspension arrangement 27, and separate the lower flange 66 of the C-beam 60, as well as the lower flange 76 of the carrier plate 58, from the horizontal bottom plate 82 of the beam suspension arrangement 27. The slide blocks 88 also stabilize the main beam 22 from pivoting in the beam suspension arrangement 27 about the longitudinal axis L.

To summarize, a side lift spreader main beam 22 may comprise a vertical carrier plate 58 having a first vertical height $H_1$ and being made of steel plate having a first thickness $T_1$; a C-beam 60 comprising a first horizontal flange 64 and a second horizontal flange 66 interconnected by a vertical web portion 68; and an inclined support plate 62 welded to the carrier plate, and to an outer face of the first flange 64 of the C-beam 60 at a distance from the carrier plate 58. The C-beam 60 may have a second vertical height $H_2$ lower than the first vertical height $H_1$ and may be made of steel plate having a second thickness $T_2$ thinner than the first thickness $T_1$.

The concepts herein have mainly been described above with reference to a few embodiments. However, as is readily appreciated by a person skilled in the art, other embodiments than the ones disclosed above are equally possible within the scope of the invention, as defined by the appended patent claims.

For example, a side lift spreader 20 for simultaneously lifting a pair of mutually stacked containers has been described in detail. The teachings herein are equally applicable on a side lift spreader for lifting a single container only.

Even though the main beam 22 is provided with telescopic traveling beams 34*a*, 34*b*, and is slidable in a beam suspension arrangement 27 along the longitudinal direction L, this is not necessary. The teachings herein may be applied to non-telescopic spreaders as well as and non-slidable main beams, and such variants are intended to be covered by the appended claims.

The invention claimed is:

1. A side lift spreader for lifting a container, the spreader comprising:

a main beam extending in a longitudinal direction;

a pair of container locking arrangements, each of said container locking arrangements being located at a respective longitudinal end of the spreader and being configured to be connected to a respective top corner casting of the container; and a container side support configured to support a longitudinal side of the container at a position vertically lower than the pair of container locking arrangements, wherein the main beam comprises:

a vertical carrier plate having a longitudinal axis extending in said longitudinal direction, the vertical carrier plate having a first vertical height and being made of a steel plate having a first thickness;

a C-beam extending in the longitudinal direction and comprising a first horizontal flange and a second horizontal flange interconnected by a vertical web portion, the C-beam having a second vertical height that is lower than the first vertical height and being made of a steel plate having a second thickness that is thinner than the first thickness, the first horizontal flange of the C-beam being welded to the vertical carrier plate along a first longitudinal weld and the second horizontal flange of the C-beam being welded to the vertical carrier plate along a second longitudinal weld such that the C-beam defines, together with the vertical carrier plate, a closed channel beam with a first flange of the vertical carrier plate extending vertically from the closed channel beam; and an inclined support plate extending along the longitudinal direction, the inclined support plate being welded to the vertical carrier plate along a third longitudinal weld, and to an outer face of the first horizontal flange of the C-beam along a fourth longitudinal weld, the fourth longitudinal weld being located at a distance from the vertical carrier plate.

2. The side lift spreader according to claim 1, wherein the main beam is configured as a traveling beam guide, wherein the spreader further comprises:

a pair of traveling beams, each of said traveling beams having a proximal end guided in the main beam to allow movement along the longitudinal direction, and a distal end connected to a respective container locking arrangement of said pair of container locking arrangements to allow changing a longitudinal distance between the container locking arrangements to accommodate for the container of different lengths.

3. The side lift spreader according to claim 2, wherein the pair of traveling beams comprises a first traveling beam and a second traveling beam, wherein the first traveling beam is guided by the main beam and telescopically slide into the second traveling beam.

4. The side lift spreader according to claim 1, wherein the C-beam is welded to a side of the vertical carrier plate configured to face, when the spreader is in use, towards the container to be lifted.

5. The side lift spreader according to claim 1, wherein said first flange of the vertical carrier plate extends upwards from the closed channel beam defined by the C-beam and the vertical carrier plate.

6. The side lift spreader according to claim 5, wherein the vertical carrier plate is provided with a second flange extending vertically downwards from the closed channel beam.

7. The side lift spreader according to claim 1, further comprising a beam suspension arrangement carrying said main beam, wherein said second horizontal flange of the C-beam has a bottom face slidingly resting on said beam suspension arrangement to allow moving the main beam relative to the beam suspension arrangement in said longitudinal direction.

8. The side lift spreader according to claim 1, wherein said inclined support plate extends along less than ¾ of a total length of the main beam.

9. The side lift spreader according to claim 1, wherein a plane defined by said inclined support plate forms an angle of between 30° and 75° with a plane defined by the vertical carrier plate.

10. The side lift spreader according to claim 1, wherein said distance between the fourth longitudinal weld and the vertical carrier plate is between 50% and 100% of a horizontal width of the first flange of the C-beam, as measured in a horizontal direction perpendicular to the longitudinal direction.

11. The side lift spreader according to claim 1, wherein the pair of container locking arrangements are movable between a 20-foot position, in which a longitudinal distance between the pair of container locking arrangements is adapted for engaging with the corner castings of a 20-foot international organization for standardization (ISO) container, and a 40-foot position, in which the longitudinal distance between the pair of container locking arrangements is adapted for engaging with the corner castings of a 40-foot ISO container.

12. The side lift spreader according to claim 1, wherein the vertical carrier plate extends along more than ¾ of a longitudinal length of the main beam.

13. The side lift spreader according to claim 1, wherein the C-beam extends along more than ¾ of a longitudinal length of the main beam.

14. The side lift spreader according to claim 1, wherein each of said container locking arrangements comprises a lifting hook provided with a barb, the barb being configured for engaging with an inner top edge of a twist-lock aperture on the longitudinal side of the container to be lifted.

15. The side lift spreader according to claim 1, wherein the container comprises an international organization for standardization (ISO) container.

16. A container lifting arrangement comprising:

a lifting truck provided with a mast;

a truck mast coupling mounted on a main beam of a side lift spreader, the truck mast coupling configured to be connected to the mast of the lifting truck, and the main beam extending in a longitudinal direction;

the side lift spreader for lifting an intermodal transport container, the spreader comprising:

a pair of container locking arrangements, each of said container locking arrangements being located at a respective longitudinal end of the spreader and being configured to be connected to a respective top corner casting of the container; and a container side support configured to support a longitudinal side of the container at a position vertically lower than the pair of container locking arrangements, wherein the main beam comprises:

a vertical carrier plate having a longitudinal axis extending in said longitudinal direction, the vertical carrier plate having a first vertical height and being made of a steel plate having a first thickness, a C-beam extending in the longitudinal direction and comprising a first horizontal flange and a second horizontal flange interconnected by a vertical web portion, the C-beam having a second vertical height that is lower than the first vertical height and being made of a steel plate having a second thickness that is thinner than the first thickness, the first horizontal flange of the C-beam being welded to the vertical carrier plate along a first longitudinal weld and the second horizontal flange of the C-beam being welded to the vertical carrier plate along a second longitudinal weld such that the C-beam defines, together with the vertical carrier plate, a closed channel beam with a first flange of the vertical carrier plate extending vertically from the closed channel beam, and an inclined support plate extending along the longitudinal direction, the inclined support plate being welded to the vertical carrier plate along a third longitudinal weld, and to an outer face of the first horizontal flange of the C-beam along a fourth longitudinal weld, the fourth longitudinal weld being located at a distance from the vertical carrier plate.

17. The container lifting arrangement according to claim 16, wherein the main beam is configured as a traveling beam guide, wherein the spreader further comprises:

a pair of traveling beams, each of said traveling beams having a proximal end guided in the main beam to allow movement along the longitudinal direction, and a distal end connected to a respective container locking arrangement of said pair of container locking arrangements to allow changing a longitudinal distance between the container locking arrangements to accommodate for the container of different lengths.

18. The container lifting arrangement according to claim 16, wherein the C-beam is welded to a side of the vertical carrier plate configured to face, when the spreader is in use, towards the container to be lifted.

19. The container lifting arrangement according to claim 16, wherein said first flange of the vertical carrier plate extends upwards from the closed channel beam defined by the C-beam and the vertical carrier plate.

20. The container lifting arrangement according to claim 16, further comprising a beam suspension arrangement carrying said main beam, wherein said second horizontal flange of the C-beam has a bottom face slidingly resting on said beam suspension arrangement to allow moving the main beam relative to the beam suspension arrangement in said longitudinal direction.

* * * * *